US007684889B2

(12) United States Patent
Focke et al.

(10) Patent No.: US 7,684,889 B2
(45) Date of Patent: Mar. 23, 2010

(54) CIGARETTE PRODUCTION AND PACKAGING UNIT AND METHOD AND DEVICE FOR CONTROL THEREOF

(75) Inventors: Heinz Focke, Verden (DE); Doris Focke, legal representative, Verden (DE); Jürgen Focke, legal representative, Verden (DE); Kurt Meyer, Kirchlinteln/Neddenaverbergen (DE); Thomas Tengen, Verden (DE)

(73) Assignee: Focke & Co. (GmbH & Co.) (DE)

( * ) Notice: Subject to any disclaimer, the term of this patent is extended or adjusted under 35 U.S.C. 154(b) by 1058 days.

(21) Appl. No.: 10/505,526

(22) PCT Filed: Mar. 5, 2003

(86) PCT No.: PCT/EP03/02236

§ 371 (c)(1),
(2), (4) Date: Feb. 18, 2005

(87) PCT Pub. No.: WO03/074361

PCT Pub. Date: Sep. 12, 2003

(65) Prior Publication Data

US 2005/0145259 A1 Jul. 7, 2005

(30) Foreign Application Priority Data

Mar. 6, 2002 (DE) ..... 102 09 753

(51) Int. Cl.
*G06F 19/00* (2006.01)

(52) U.S. Cl. ..... 700/116; 700/117; 53/148; 131/283

(58) Field of Classification Search ..... 700/115–117; 53/55, 168, 201, 507, 451; 131/283
See application file for complete search history.

(56) References Cited

U.S. PATENT DOCUMENTS 5,359,918 A 11/1994 Meili et al.

(Continued)

FOREIGN PATENT DOCUMENTS

DE 35 19 580 C1 3/1987

(Continued)

OTHER PUBLICATIONS

TORTA Research S.r.l. Remarks concenring the patentability of European patent application 03711924.5 (Oct. 7, 2004).

(Continued)

*Primary Examiner*—Paul L Rodriguez
*Assistant Examiner*—Nathan Laughlin
(74) *Attorney, Agent, or Firm*—Smith, Gambrell & Russell

(57) ABSTRACT

A production and packaging installation with a control arrangement (33) and production units having respectively adjustable mechanisms, such as, a (cigarette-) production machine (maker 10), a packaging machine (packer 11), possibly a film-wrapping machine (12), possibly a multipacker (13) and possibly a carton packer (cartoner 14), for the production and ready-to-dispatch packaging of, in the first instance, products—cigarettes and cigarette packs—of a first type and, thereafter, products of a second type each comprising starting materials, such as paper blanks, film and the like, and also specifies the control arrangement itself and a method of controlling the line, it being the case that at least a first set of parameters (61) associated with products of the first type and a second set of parameters (62) associated with products of the second type are stored in a selectable manner in a memory of the control arrangement (33) and, upon selection of a set of parameters (61, 62), a manipulated variable for adjusting the or each adjustable mechanism can be transmitted to the or each production unit by the control arrangement (33), by way of the selected parameters.

39 Claims, 9 Drawing Sheets

U.S. PATENT DOCUMENTS

| | | | | |
|---|---|---|---|---|
| 5,537,798 | A * | 7/1996 | Fukuda et al. | 53/55 |
| 5,628,162 | A | 5/1997 | Kreusch | |
| 6,044,615 | A * | 4/2000 | Fukuda | 53/64 |
| 6,308,492 | B1 | 10/2001 | Focke et al. | |
| 6,516,811 | B1 | 2/2003 | Focke | |
| 2001/0032138 | A1 * | 10/2001 | Janiak et al. | 705/19 |
| 2002/0017080 | A1 * | 2/2002 | Spatafora | 53/461 |

FOREIGN PATENT DOCUMENTS

| | | | |
|---|---|---|---|
| DE | 38 30 428 | A1 | 3/1989 |
| DE | 33 47 459 | C2 | 4/1993 |
| DE | 37 37 973 | C2 | 8/1993 |
| DE | 40 18 266 | C2 | 10/1997 |
| DE | 198 41 138 | A1 | 11/1999 |
| DE | 199 43 468 | A1 | 3/2001 |
| DE | 101 15 200 | A1 | 10/2002 |
| EP | 0 524 828 | A1 | 7/1993 |
| EP | 0 613 768 | A1 | 9/1994 |
| EP | 0 716 019 | A1 | 6/1996 |
| EP | 1 067 048 | A1 | 1/2001 |
| EP | 1 130 485 | A | 9/2001 |
| EP | 1 266 830 | A | 12/2002 |
| FR | 2 681 847 | A1 | 4/1993 |
| GB | 2 145 046 | A | 3/1985 |
| GB | 2 235 122 | A | 10/2003 |
| JP | 2000-025710 | | 1/2000 |
| JP | 2000-295984 | | 10/2000 |
| JP | 2003-011926 | | 1/2003 |
| JP | 2003-026128 | | 1/2003 |
| NL | 9 400 392 | A | 10/1995 |
| NL | 1 003 658 | C1 | 1/1998 |
| WO | WO 93/01092 | | 1/1993 |

OTHER PUBLICATIONS

Deutsches Patent- und Markenamt Recherchebericht (Mar. 20, 2002).
Japanese Office Action With English Translation.
EP Search Report No. EP 06 01 1827 dated Aug. 16, 2006.

* cited by examiner 57
50
48
51
64
77
75
53
340
37
75
64
65
65
06
78
76
74
76
48

CIGARETTE PRODUCTION AND PACKAGING UNIT AND METHOD AND DEVICE FOR CONTROL THEREOF

STATEMENT OF RELATED APPLICATIONS

The above-captioned patent application is the Unites States Patent Cooperation Treaty (PCT) Chapter II National Phase of International Application No. PCT/EP03/02236, having an International Application Date of 5 Mar. 2003, which in turn claims priority on German Patent Application No. 10209753.4, having a filing date of 6 Mar. 2002, designating the United States of America.

BACKGROUND OF THE INVENTION

1. Technical Field

The invention relates to a method of controlling a production and packaging installation—line—having production units having respectively adjustable mechanisms, such as, in particular, a (cigarette-) production machine (maker), a packaging machine (packer), possibly a film-wrapping machine, possibly a multipacker and possibly a carton packer (cartoner), for the production and, in particular, ready-to-dispatch packaging of, in the first instance, products—cigarettes and cigarette packs—of a first type and, thereafter, products of a second type each comprising starting materials, in particular blanks such as paper or cardboard blanks, film and the like.

The invention also relates to a control arrangement for implementing the method. Finally, the invention relates to a production and packaging installation—line—having a control arrangement and production units having respectively adjustable mechanisms, as mentioned above, for the production and, in particular, ready-to-dispatch packaging of, in the first instance, products—cigarettes and cigarette packs—of a first type and, thereafter, products of a second type each comprising starting materials, in particular blanks such as paper or cardboard blanks, film and the like.

2. Prior Art

DE 199 14 297 discloses a method of the generic type and a corresponding arrangement.

BRIEF SUMMARY OF THE INVENTION

The object of the invention is to improve the production and packaging installation and the method of controlling such an installation.

The object is achieved by a production and packaging installation—referred to hereinbelow as "line" for short—having a control arrangement and production units having respectively adjustable mechanisms, such as, in particular, a (cigarette-) production machine (maker), a packaging machine (packer), possibly a film-wrapping machine, possibly a multipacker and possibly a carton packer (cartoner), for the production and, in particular, ready-to-dispatch packaging of, in the first instance, products, such as cigarettes and cigarette packs, of a first type and, thereafter, products of a second type each comprising starting materials, in particular blanks such as paper or cardboard blanks, film and the like, in that at least a first set of parameters associated with products of the first type and a second set of parameters associated with products of the second type are stored in a selectable manner in a memory of the control arrangement and, upon selection of a set of parameters, a manipulated variable for adjusting the or each adjustable mechanism can be transmitted to the or each production unit by the control arrangement, by way of the selected parameters. Any components of a functional unit which can be effected by a manipulated variable is referred to as an adjustable mechanism. A component which can be influenced in terms of its relative position by a position-describing manipulated variable is likewise an adjustable mechanism, for example a heater which can be influenced by a desired temperature or an optical sensor which can be influenced by a threshold value for stipulating a response threshold.

The object is likewise achieved by production and packaging installations having a control arrangement and production units having respectively adjustable mechanisms, such as, in particular, a (cigarette-) production machine (maker), a packaging machine (packer), possibly a film-wrapping machine, possibly a multipacker and possibly a carton packer (cartoner), for the production and, in particular, ready-to-dispatch packaging of, in the first instance, products—cigarettes and cigarette packs—of a first type and, thereafter, products of a second type each comprising starting materials, in particular blanks such as paper or cardboard blanks, film and the like, wherein at least a first set of parameters associated with products of the first type and a second set of parameters associated with products of the second type, this set comprising a code for each required starting material, are stored in a selectable manner in a memory of the control arrangement, and wherein either a material code can be determined for the starting material present at the or each production unit and upon selection of a set of parameters, the material code of the starting material present at the or each production unit can be compared with the corresponding code from the selected set of parameters, or the starting material which can be used in the or each production unit comprises a readable material code and upon selection of a set of parameters, the or each production unit can be fed usable starting material by way of the code from the selected set of parameters.

The object also likewise is achieved by production and packaging installations having a control arrangement and production units having respectively adjustable mechanisms, such as, in particular, a (cigarette-) production machine (maker), a packaging machine (packer), possibly a film-wrapping machine, possibly a multipacker and possibly a carton packer (cartoner), for the production and, in particular, ready-to-dispatch packaging of, in the first instance, products—cigarettes and cigarette packs—of a first type and, thereafter, products of a second type each comprising starting materials, in particular blanks such as paper or cardboard blanks, film and the like, wherein at least a first set of parameters associated with products of the first type and a second set of parameters associated with products of the second type are stored in a selectable manner in a memory of the control arrangement, wherein each set of parameters contains a number of necessary starting materials, wherein at least one product-type-related set of parameters for linking up starting materials is stored in the memory, and wherein, upon selection of a set of parameters, a manipulated variable for adjusting the or each adjustable mechanism can be transmitted to the or each production unit by the control arrangement, by way of the selected parameters and/or of the product-type-related set of parameters.

Furthermore, the object is achieved by a corresponding method of controlling a production and packaging installation—line—having production units having respectively adjustable mechanisms, such as, in particular, a (cigarette-) production machine (maker, a packaging machine (packer), possibly a film-wrapping machine, possibly a multipacker and possibly a carton packer (cartoner), for the production and, in particular, ready-to dispatch packaging of, in the first instance, products—cigarettes and cigarette packs—of a first type and, thereafter, products of a second type each comprising starting materials, in particular blanks such as paper or cardboard blanks, film and the like, wherein, in order to change over from products of the first type to products of the second type, a related set of parameters is selected, and wherein an adjustment of the or each adjustable mechanism of the or each production unit takes place by way of the selected parameters.

The object likewise is achieved by a corresponding method of controlling a production and packaging installation—line—having production units having respectively adjustable mechanism, such as, in particular, a (cigarette-) production machine (maker, a packaging machine (packer, possibly a film-wrapping machine, possibly a multipacker and possibly a carton packer (cartoner), for the production and, in particular, ready-to dispatch packaging of, in the first instance, products—cigarettes and cigarette packs—of a first type and, thereafter, products of a second type each comprising starting materials, in particular blanks such as paper or cardboard blanks, film and the like, wherein, in order to change over from products of the first type to products of the second type, a set of related parameters, which comprises a code for each required starting material, is selected, and wherein either a material code is determined for the starting material present at the or each production unit and the material code of the starting material present at the or each production unit is compared with the corresponding code from the selected set of parameters, or upon selection of a set of parameters, the or each production unit is fed usable starting material by way of the code from the selected set of parameters and of a readable material code of the starting material.

The object likewise is achieved by a corresponding method of controlling a production and packaging installation—line—having production units having respectively adjustable mechanisms, such as, in particular, a (cigarette-) production machine (maker, a packaging machine (packer), possibly a film-wrapping machine, possibly a multipacker and possibly a carton packer (cartoner), for the production and, in particular, ready-to-dispatch packaging of, in the first instance, products—cigarettes and cigarette packs—of a first type and, thereafter, products of a second type each comprising starting materials, in particular blanks such as paper or cardboard blanks, film and the like, wherein, in order to change over from products of the first type to products of the second type, a set of related parameters, which comprises a number of necessary starting materials, is selected, and wherein, upon selection of a set of parameters, a manipulated variable for adjusting the or each adjustable mechanism is transmitted to the or each production unit by the control arrangement, by way of the selected parameters and of a product-type-related set of parameters which comprises predetermined or preterminable links between starting materials and, for each link, at least one manipulated variable for adjusting an adjustable mechanism.

The object likewise is achieved by a control arrangement which is suitable for implementing the or each method having a memory and at least one communications interface, wherein at least a first set of parameters associated with products of the first type and a second set of parameters associated with products of the second type are stored in a selectable manner in the memory, and wherein, upon selection of a set of parameters, a manipulated variable can be transmitted to the or each production unit via the communications interface, for the purpose of adjusting the or each adjustable mechanism.

The invention is based on the finding that, during changeover from a product of a first type to a product of a second type, on the one hand, an unnecessarily long period of time elapses because high-outlay adjustments have to be made to individual production units or all the production units, appropriate starting material has to be supplied or the starting material which is present has to be checked for suitability for use for a product of the second type and, on the other hand, following the changeover, incorrect production takes place to a considerable extent until, finally, the operating staff has adjusted all the production units correctly, during operation of the line, to the product which is to be produced. A set of parameters is thus provided for each product. For changeover from products of a first type to products of a second type, the corresponding set of parameters is selected, for example, at an operating station having input and output functions such as a screen and keyboard. By way of the selected parameters, suitable adjustment of the or each adjustable mechanism of the or each production unit and/or checking or supply of the starting material, or of starting material, then take place automatically.

The advantage of the invention is that, following this adjustment and/or the checking or supply of starting material, the production and, in particular, ready-to-dispatch packaging of the product of the second type can begin immediately, with the result that standstill periods are reduced. Furthermore, the individual production units are adjusted optimally to the product of the second type, with the result that any possible incorrect production is prevented. Expedient developments of the line, of the method and of the control arrangement form the subject matter of respectively subordinate claims.

BRIEF DESCRIPTION OF THE DRAWINGS

A preferred exemplary embodiment of the invention is explained in more detail hereinbelow with reference to the drawing, in which.

DETAILED DESCRIPTION OF THE PREFERRED EMBODIMENTS

Figure 1:
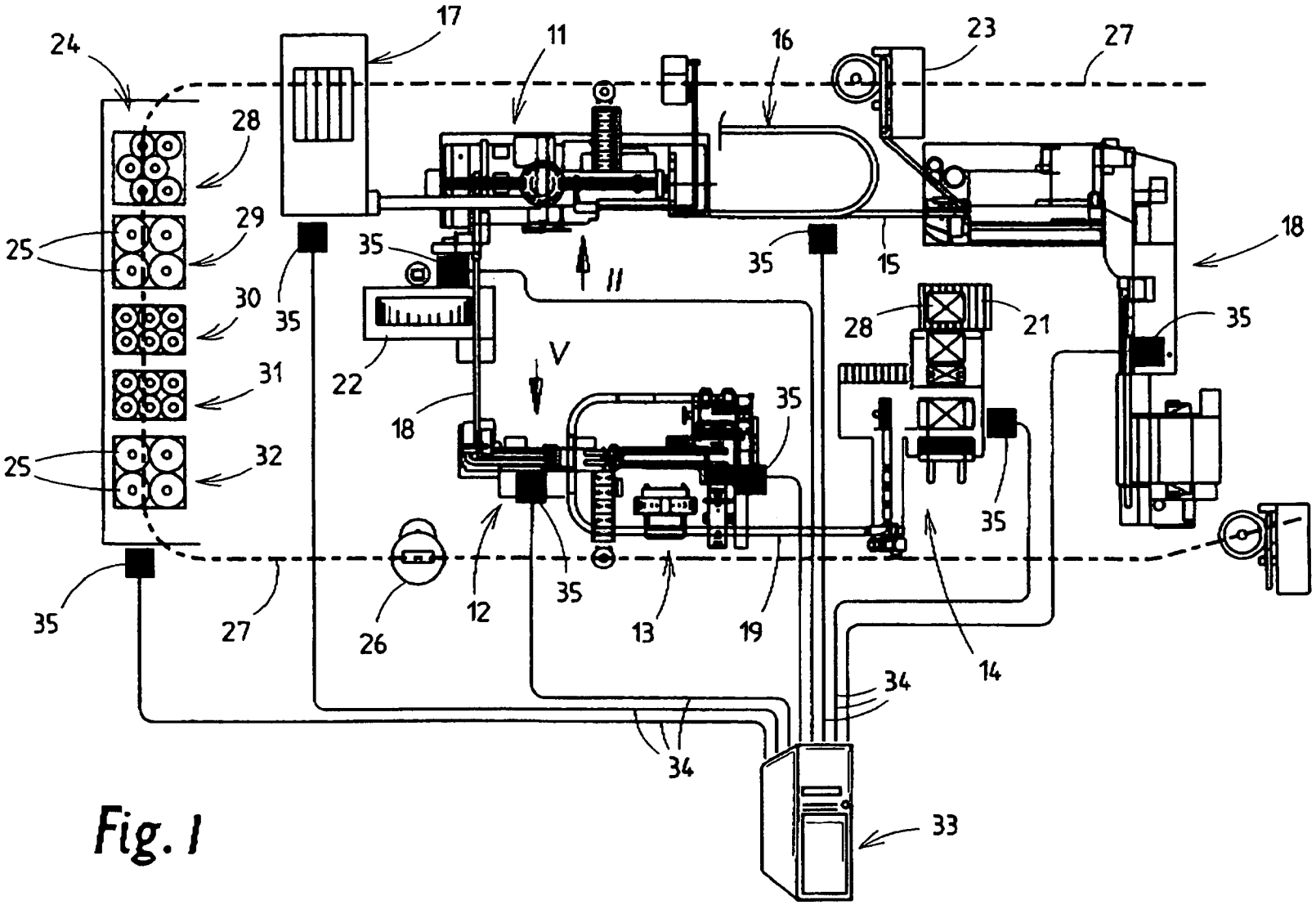
FIG. 1 shows a schematic plan view of a production and packaging installation for cigarettes.

The exemplary embodiment illustrated in the drawings relates to a production and packaging installation for cigarettes, that is to say a so-called line. This line comprises production units, namely, for example, a cigarette-production machine, namely a maker 10, a packaging machine following the latter, that is to say a packer 11, a subsequent film-wrapping machine 12, a packaging machine for producing multipacks from a plurality of cigarette packs 48, that is to say a multipacker 13, and a cartoner 14, which packages the multipacks, that is to say cigarette multipacks, in a shipping carton. The cigarettes produced by the maker 10 are fed by a cigarette conveyor 15, with an associated cigarette store 16, to the packer 11, e.g. a hinge-lid packer for producing hinge-lid boxes. The packer 11 is assigned a blank store 17, that is to say a device for accommodating a relatively large supply of prefabricated blanks for the hinge-lid box, the blank store having conveying mechanisms for feeding blank stacks to the packer 11. The (cigarette) packs 48 produced by the packer 11 are fed, via a pack conveyor 18, to the film-wrapping machine 12. The latter has the task of wrapping the cigarette packs 48 in an outer film or plastic blank. The finished cigarette packs 48 are used to form pack groups, which are provided with a multipack wrapper in the region of the multipacker 13 and thus produce a cigarette multipack comprising usually ten cigarette packs 48. These cigarette multipacks are fed, by a multipack conveyor 19, to the cartoner 14. The latter transfers finished shipping cartons 20, with a plurality of cigarette multipacks, to a removal conveyor 21. Located in the region of the pack conveyor 18, between the packer 11 and film-wrapping machine 12, is a pack store 22 for accommodating a relatively large number of cigarette packs 48 (without outer wrapper).

The above-described production units have to be supplied with material. The maker 10 has to be fed a sufficient quantity of tobacco and also cigarette paper in the form of wound webs, namely reels. Furthermore, the maker 10 likewise has to be fed filter-attachment paper wound in the form of reels, in order that the cigarettes produced can be supplied with the appropriate material in the region of a filter-attachment machine 23. The other production units likewise have to be fed packaging material in wound webs, that is to say in the form of reels. This applies to the production of a collar which is customary in cigarette packs 48 of the hinge-lid-box type, and also to an inner wrapper, a so-called inner liner of the cigarette group, and to the outer wrapper made of film or cellophane. A central storage area 24 is provided for all the material, the reels 25 of different materials being stored, for example, on pallets in this storage area. A suitable conveying arrangement, for example a common material conveyor 26, can be displaced along a conveying path 27 between the storage area 24 and the individual production units for the purpose of feeding the reel material as required. In the case of the example shown, the storage area 24 may be constructed such that filter-attachment paper 28, collar material 29, inner-liner material 30, film material 31 and cigarette paper 32 are positioned in the region of the conveying path 27 in order to be received by the material conveyor 26, to be precise in each case in a favorable position relative to the associated production unit.

The sequence from the production of the cigarettes to the production of the finished shipping cartons 20 filled with cigarette multipacks takes place under the control of a control arrangement 33, which is connected communicatively to each production unit, specifically to a respective machine controller 35 assigned locally to the or each production unit, for example via a bus, in particular a field bus 34 or a local network, in particular a PC network. Via the field bus 34, the control arrangement 33 exchanges data with a or each production unit in each case and, in the process, transmits, for example, manipulated variables to the respective production unit or receives production-related data. The control arrangement 33 is, for example, a process computer or a central processing unit of a programmable controller. Codes for all the materials used during production and packaging of the cigarettes are stored in a suitable data structure in a memory (not illustrated) of the control arrangement 33. Allocation of a material to at least one production unit in each case is likewise stored by way of the code in this memory.

Figure 2:
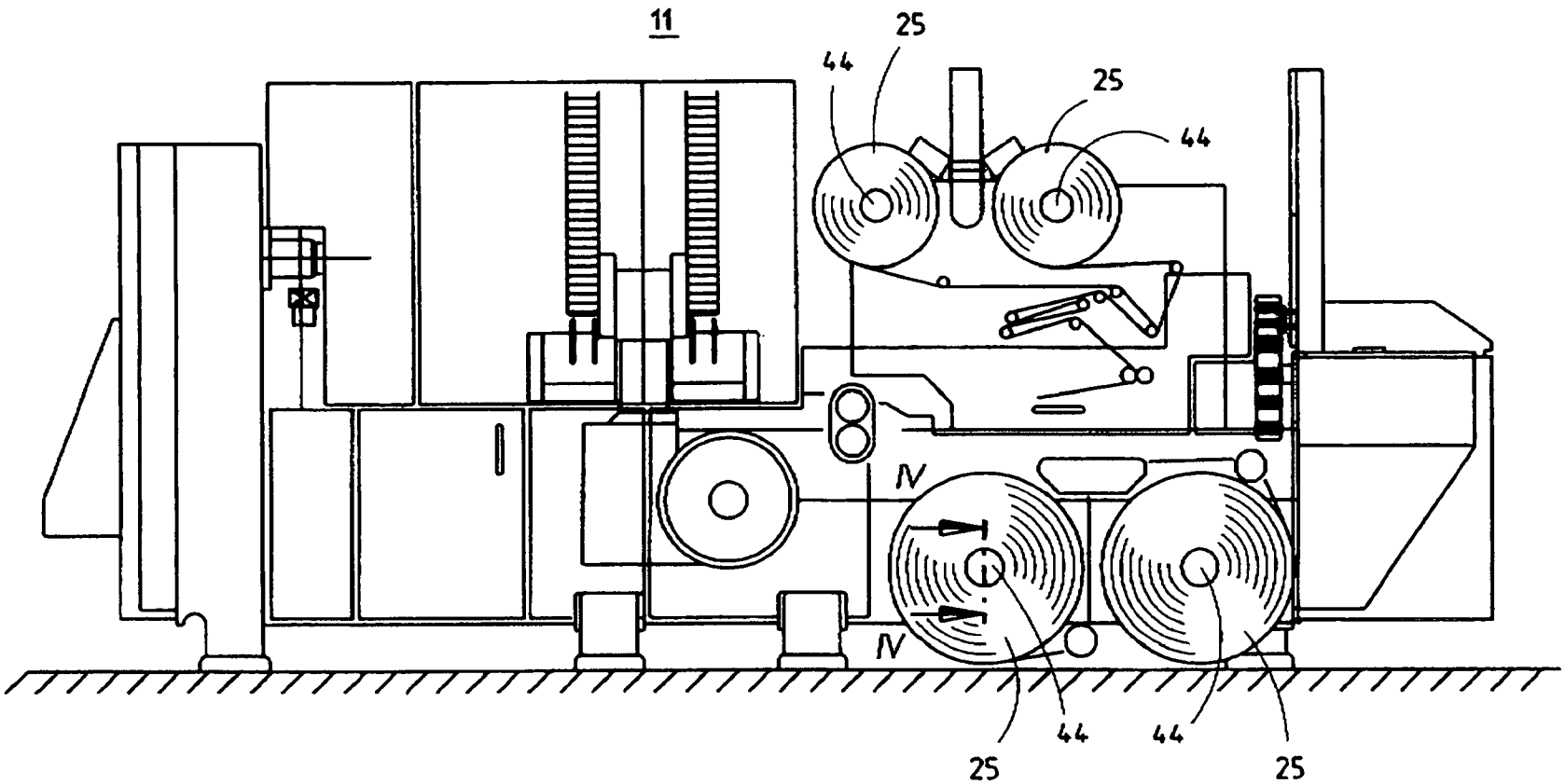
FIG. 2 shows a view of a packer.
Figure 3:
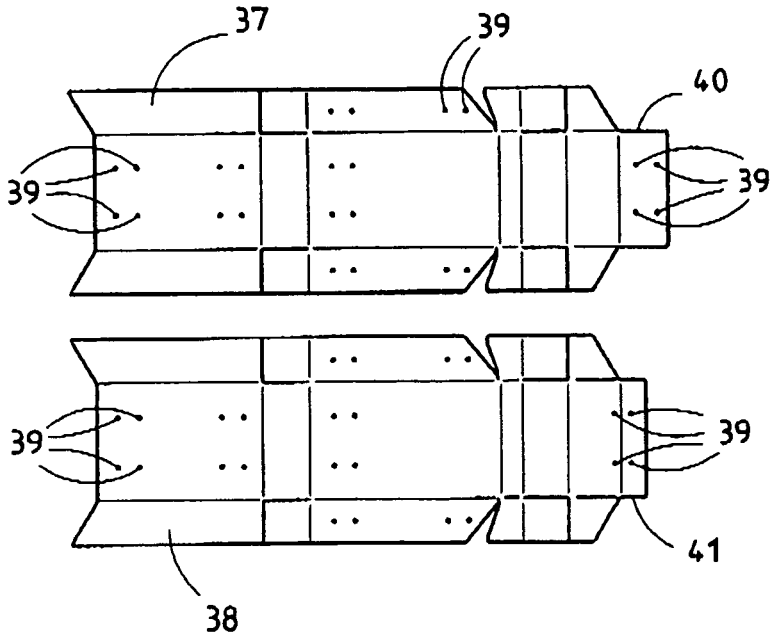
FIG. 3 shows blanks.

FIG. 2 shows a view of the packer 11 (see view II in FIG. 1). The packer 11 processes blanks 37, 38, such as paper or cardboard blanks, into cigarette boxes by folding and adhesive bonding. In addition, the packer 11 processes starting materials supplied on reels 25, e.g. paper or cardboard webs. A first and a second blank 37, 38 made of (thin) cardboard for producing a cigarette box is illustrated in FIG. 3. Each blank is distinguished by characteristic cut edges (thick lines) and folding edges (thin lines). Areas of glue 39 are provided in order to fix a folded blank 37, 38 and to fix a so-called inner or film block, i.e. the wrapped or encased cigarette block and a collar. All the areas of glue 39 together are referred to as a pattern of glue. Depending on the type of cigarette, it is possible to use different cigarette boxes to accommodate the cigarettes. The cigarette boxes differ in respect of the type of basic blank 37, 38 and in respect of the pattern of glue which is applied in each case. The first and second blanks 37, 38 differ by way of a long lid inner tab 40 and a short lid inner tab 41, respectively, and of the pattern of glue in the region of the respective lid inner tab 40, 41.

In order to fold a respective blank 37, 38, the packer 11 (FIG. 1) has adjustable mechanisms which are not illustrated specifically, e.g. folding mechanisms which are known per se and are adjusted in a suitable manner in dependence on the blank 37, 38 which is to be processed. In addition, the packer 11 likewise has glue nozzles (not illustrated specifically) which are known per se and are intended for applying the areas of glue 39 to the respective blank 37, 38. It is also the case that the or each glue nozzle is an adjustable mechanism, the adjustment consisting, for example, in a relative movement between individual glue nozzles in order to achieve a predetermined area of glue 39 or in activating or deactivating individual glue nozzles among a multiplicity of glue nozzles which are combined in the manner of a matrix.

Figure 4:
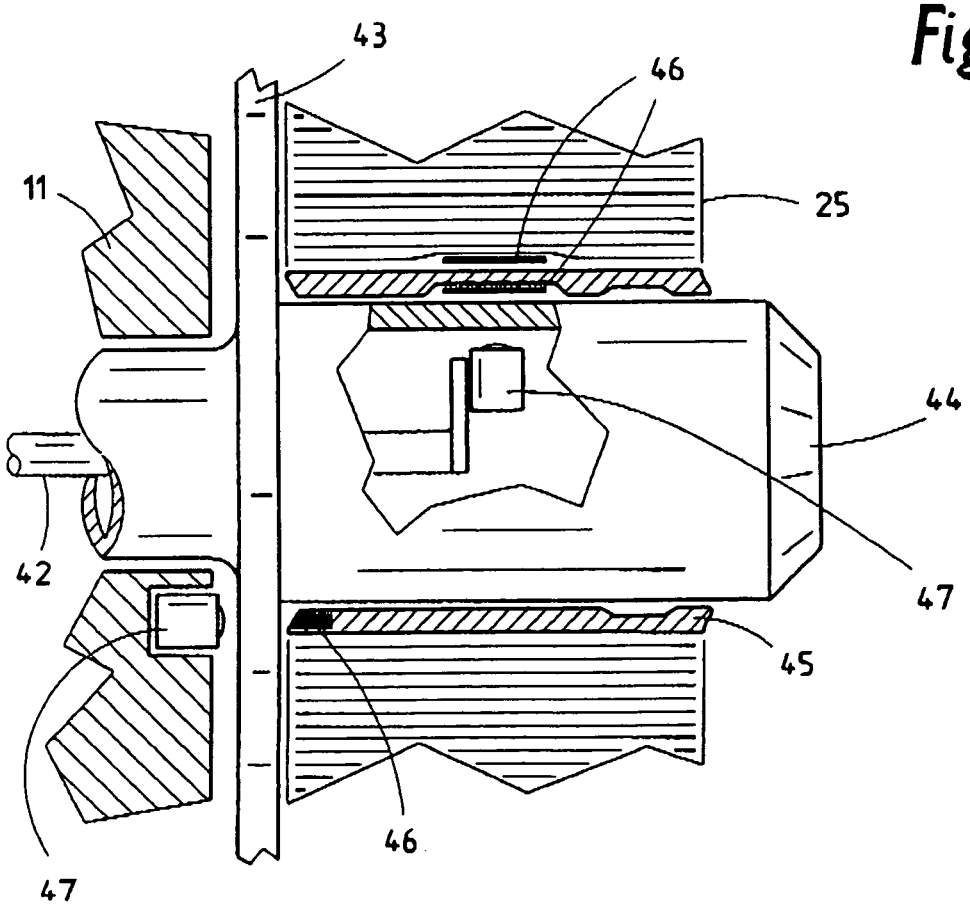
FIG. 4 shows a reel with transponders and associated readers provided at different positions.

FIG. 4 shows a sectional illustration along section line IV-IV (FIG. 2) of the reel 25 and part of the housing of the packer 11. The reel 25 is arranged on a plate 43 which is mounted in a rotatable manner by means of a spindle 42 and has a central stub 44. The reel 25 contains, in its interior, a reel core 45, around which the respective starting material is wound. A transponder 46 for identifying the respective starting material by way of a material code stored therein is provided on the reel 25. The transponder 46 interacts with a reader 47. The transponder 46 is arranged, for example, on or in a foot of the reel core 45 and interacts with a reader 47 which is oriented appropriately in a stationary manner, on the housing of the packer 11, parallel to the axis of rotation of the reel 25. As an alternative, the transponder 46 is arranged either on the reel core 45 or at one end of the material web and interacts with a reader 47 which is oriented appropriately in a stationary manner, in the interior of the stub 44, perpendicularly to the axis of rotation of the reel 25. Each transponder 46 arranged on the reel core 45 is preferably designed as a re-writable transponder 46. It is then possible, in the case of a reel 25 which is in use, for the quantity of material still remaining to be stored on the transponder 46, with the result that, when the material code is read out, it is also possible to determine, for example, how many cigarette boxes can still be produced or packaged using the remaining material. Once the material has been used up, a new material code and associated quantity information can be stored on the transponder. The data of the transponder 46 provided on the material or on the reel 25 may also give details of the respective material manufacturer, with the result that certain information and control signals for influencing individual production units and/or for adjusting adjustable mechanisms can be derived therefrom. This is because the material from different manufacturers often has different physical properties. For example, the films for outer wrappers of cigarette packs 48 have different properties which may make it necessary to adapt, for example, the sealing temperature of sealing mechanisms.

Figure 5:
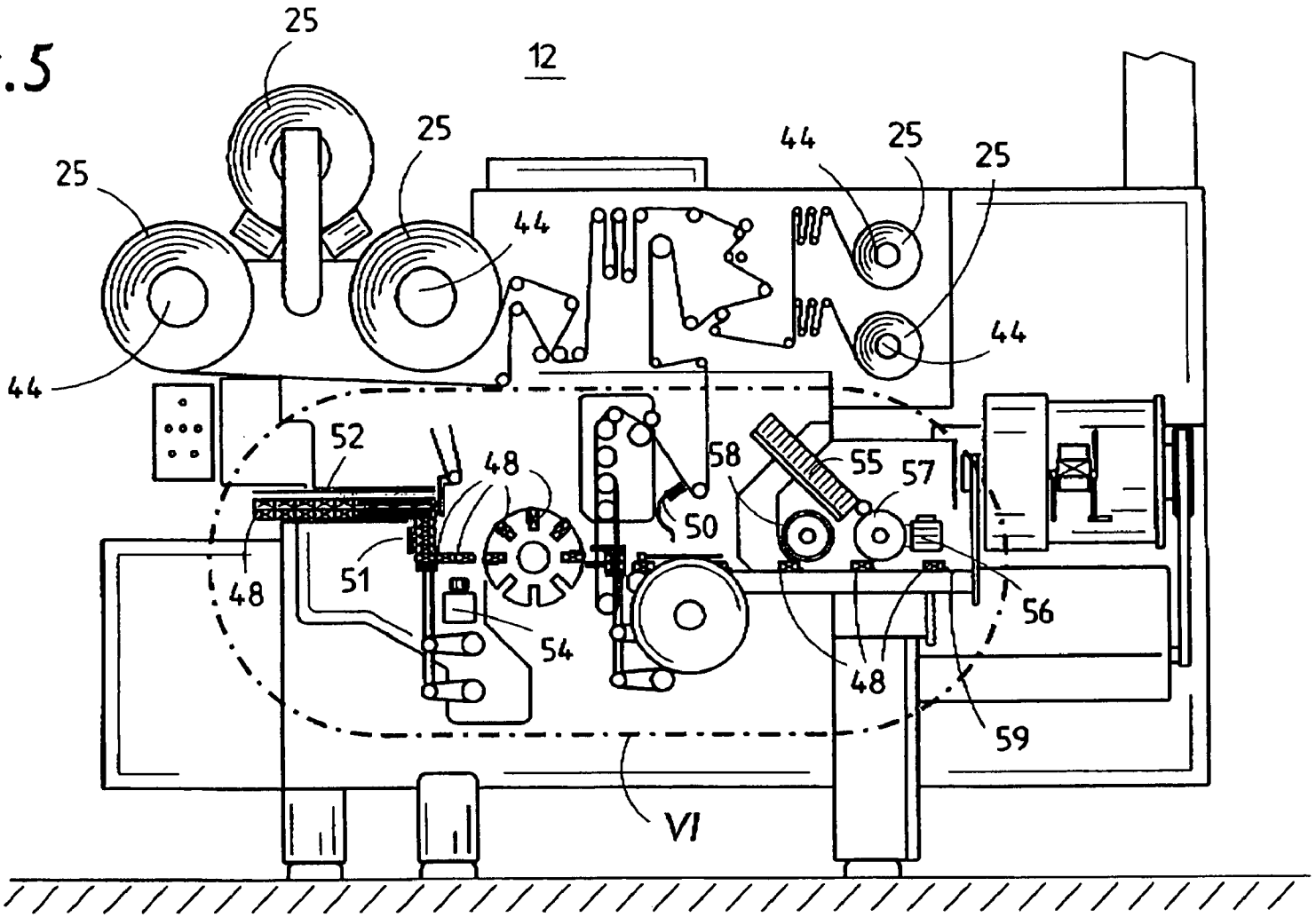
FIG. 5 shows a view of a film-wrapping machine.
Figure 6:
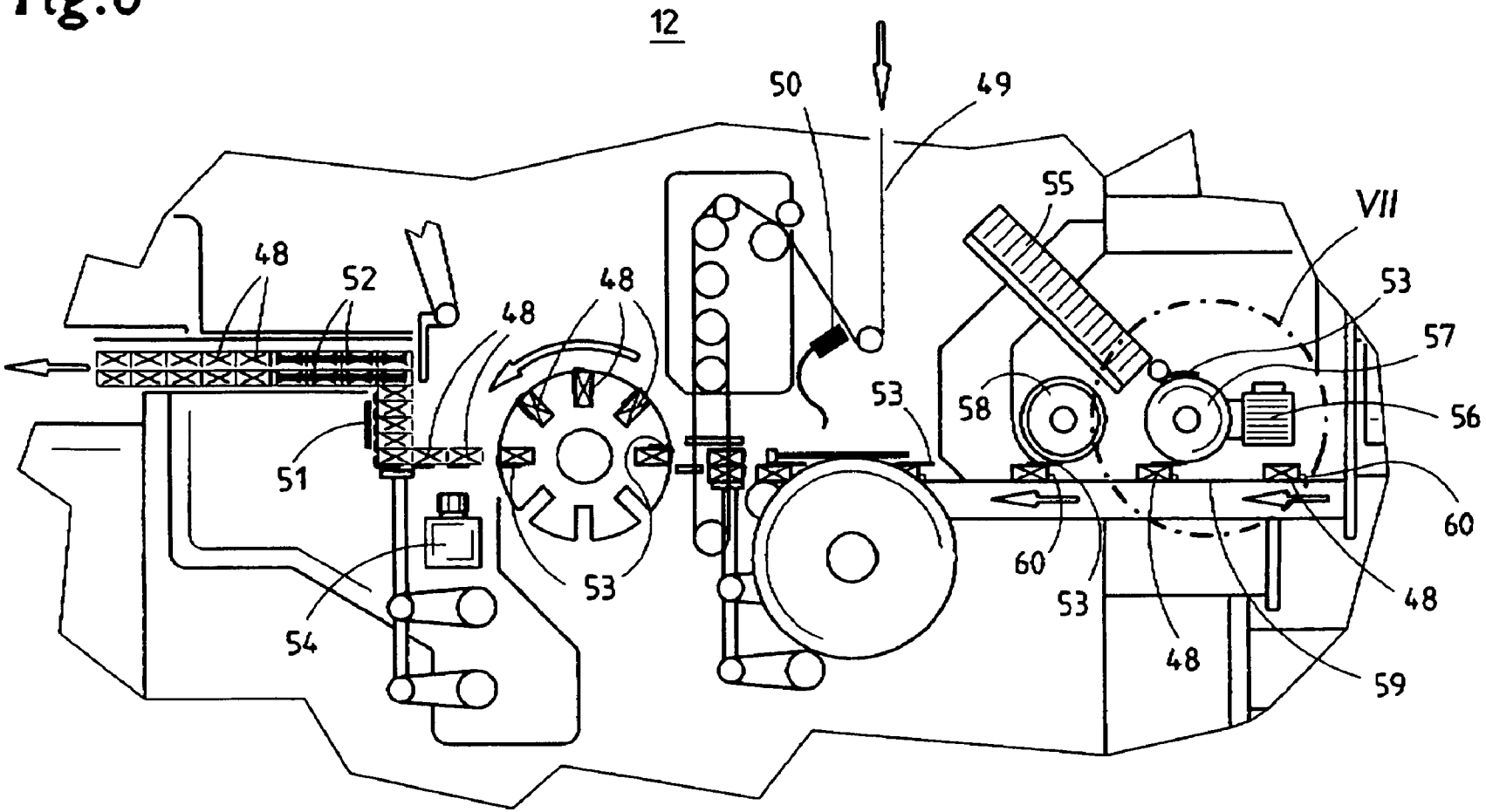
FIG. 6 shows a central region of the film-wrapping machine.

FIG. 5 shows a view of the film-wrapping machine 12 (see view V in FIG. 1) with starting material fed on reels 25 in each case. A central region (view VI) of the film-wrapping machine 12 is illustrated in FIG. 6.

The film-wrapping machine 12 wraps cigarette packs 48 in a film; for this purpose, it processes a film web (cellophane web 49) and, if appropriate, a tear-open thread. The essentially horizontal conveying path of the cigarette packs 48 through the film-wrapping machine 12 is illustrated by corresponding arrows. The wrapping film 64 (FIG. 9) is guided, as a cellophane web 49, over various rollers in the film-wrapping machine 12. In this case, the cellophane web 49 is also guided past an optical sensor designed as a light barrier 50. The light barrier 50 serves for detecting a printed mark provided on the cellophane web 49. The light barrier 50 is thus also an adjustable mechanism. The adjustment consists, for example, in the stipulation of a threshold value for the signal supplied in each case or in a variation of a time section (machine angle) whereas the signals thereof are evaluated by the light barrier 50 or in a relative movement of the light barrier 50 itself for the purpose of checking predetermined positions on the cellophane web 49. The cigarette packs 48 wrapped in film are guided along a first and second heater 51, 52, the first heater 51 being provided for sealing a longitudinal seam of the film enclosing the cigarette box 48 and the second heater 52 being provided for sealing a lid and a base of the film wrapper. The or each heater 51, 52 is a constituent part of a sealing mechanism, which subjects the material which is to be sealed both to temperature and to pressure. The heater 51, 52 or the sealing mechanism, referred to hereinbelow as sealing mechanism for short, is likewise an adjustable mechanism. The adjustment consists in the stipulation, for example, of a desired temperature for the heater and, if appropriate, in the stipulation of a pressure. Furthermore, in the case of a sealing mechanism, the adjustment may also comprise a relative movement in order to center, for example, the heater over the material ends which are to be sealed.

A mechanism of the film-wrapping machine 12, a label apparatus, provides the cigarette packs 48 with a label 53, e.g. a revenue stamp. In order to check the presence and position of the label 53, a CCD camera 54 is provided as a further adjustable mechanism. The adjustment of the CCD camera 54 consists essentially in the stipulation of, for example, threshold or limit values, in order for it to be possible to distinguish, for example, a label 53 of relatively low average brightness from one with relatively high average brightness. Furthermore, in a CCD camera 54 which is suitable for detecting straightforward optical structures, e.g. edges, it is possible to transmit, for adjustment purposes, data relating to type, number and position of the expected edges, in order for it to be possible to distinguish a label 53 with a first edge pattern from one with a different edge pattern. Finally, it is possible, for adjustment purposes, for data relating to an expected position of the label 53 on the cigarette pack 48 or further data relating to the appearance or to appearance features, such as gray components, contrast or pattern, etc. of the label 53, to be transmitted to the CCD camera 54. It is also possible here for a number of different images for representing respectively different labels 53 and for comparison with the respectively detected labels 53 to be transmitted to the CCD camera 54. It is thus possible to distinguish incorrectly positioned, absent or incorrect labels 53 from correct labels 53. The correct position of a label 53 may vary in dependence on the cigarette packs 48 produced.

Figure 7:
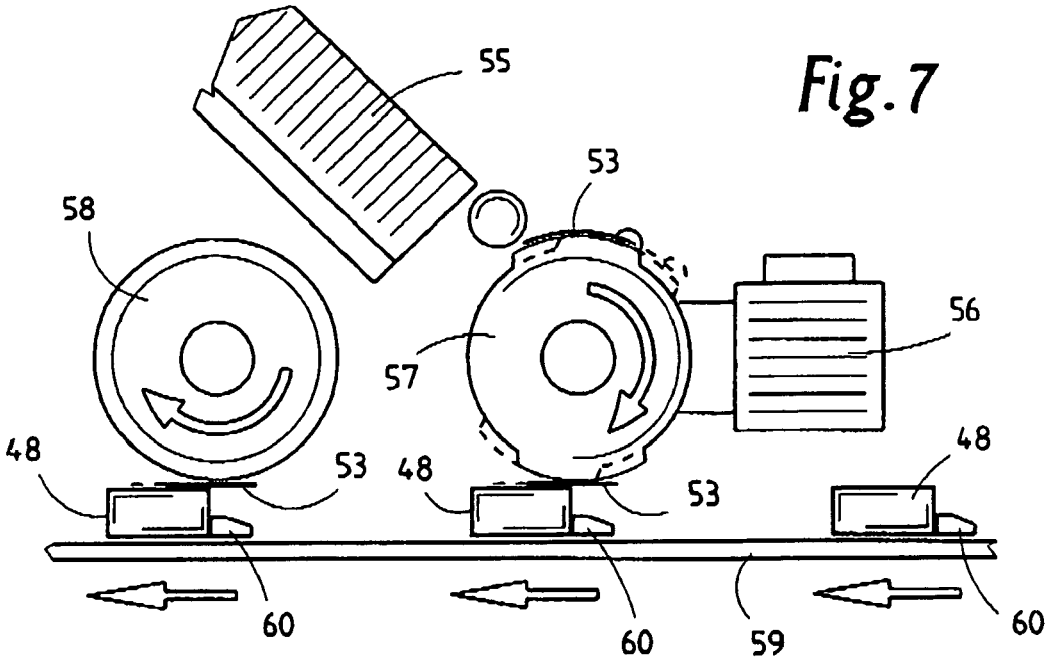
FIG. 7 shows a label apparatus as a detail of the film-wrapping machine.
Figure 8:
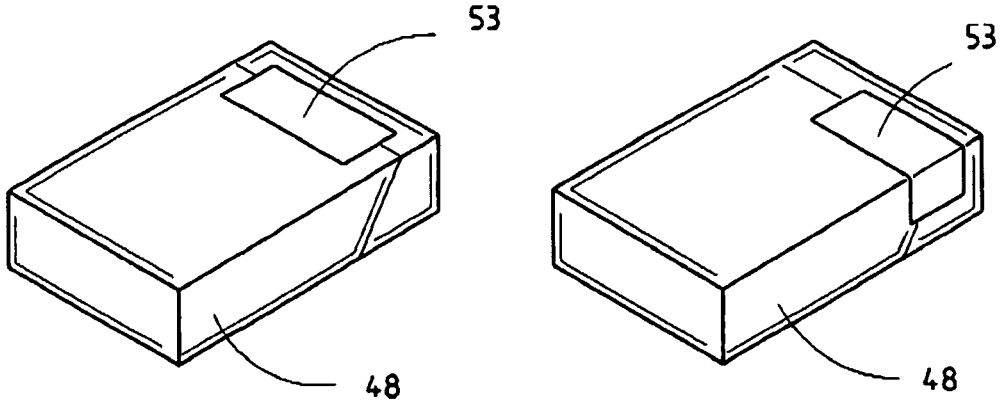
FIG. 8 shows cigarette packs with labels positioned thereon.

FIG. 7 shows the label apparatus as a detail (see view VII) of the film-wrapping machine 12, the label apparatus having a label store 55, a cam plate 57, which is driven by a servomotor 56 and is intended for transporting a label 53 and positioning it in each case on a cigarette pack 48, and a pressure-exerting disk 58 for fixing the positioned label 53 on the cigarette pack 48 as the latter is transported further through the film-wrapping machine 12. Provided for the purpose of transporting the cigarette packs 48 through the label apparatus is a conveying belt 59, on which the cigarette packs 48 rest. The cigarette packs 48 are fixed in the transporting direction (indicated by horizontally directed arrows) on the conveying belt 59 by equidistantly arranged carry-along elements 60. The label apparatus or at least the cam plate 57 thereof together with the driving servomotor 56, referred to hereinbelow as label apparatus for short, is likewise an adjustable mechanism. By virtue of the label apparatus being adjusted, it is possible to configure the latter, for example, for positioning the label 53 flat or over corners. FIG. 8 shows, on the left-hand side, a cigarette pack 48 with a flatly positioned label 53 and, on the right-hand side, a cigarette pack 48 with a label 53 which runs over at least one corner of the cigarette pack 48.

FIG. 7 illustrates the label 53 which is positioned over corners using a continuous, bold line and the flatly positioned label 53 using dashed lines. The cam plate 57 transports in each case one label 53 on the or each cam. The rotary movement of the cam plate 57 and the translatory movement of the conveying belt 59 with the cigarette packs 48 resting thereon are coordinated with one another, e.g. by means of an electric shaft. The coordination ensures that, whenever a cigarette pack 48 is located in a suitable position beneath the cam plate 57, the cam with the label 53 is also located in a position for positioning the label 53 on the cigarette pack 48. The cam of the cam plate 57 is illustrated by a continuous line in the position for positioning the label 53 over corners and by dashed lines in the position for positioning the label 53 flat. In the case of an imaginary line running vertically through the axis of rotation of the cam plate 57 and centrally through the cam, an angle is produced between a first such line through the cam in its position for positioning the label 53 flat and a second such line through the cam in its position for positioning the label 53 over corners, this angle describing a rotary offset of the two cam positions. The adjustment of the label apparatus thus consists essentially in the stipulation of the respective position of the cam in relation to a cigarette pack 48 located beneath the cam plate 57. The rotation of the cam plate 57 is coupled to the movement of the conveying belt 59. The adjustment of the label apparatus is thus related to a rotary offset in the sense of the cam plate 57 and the conveying belt 59 leading or trailing. The adjustment may take place by the stipulation of a relative rotation in relation to a reference position of the cam plate 57, in which case respectively appropriate rotary offset is taken into account for adjustment of the label apparatus for positioning labels flat and over corners. The reference position may also correspond, for example, with the position for positioning labels flat, with the result that, for an adjustment for positioning labels flat, the reference values are reproduced and, for an adjustment for positioning labels over corners, an appropriate rotary offset is taken into account. Finally, a third possibility of adjusting the label apparatus consists in briefly decelerating or accelerating the conveying belt 59, with the result that the cigarette packs 48 are located in the respectively necessary position beneath the cam of the cam plate 57 which is located above the cigarette pack 48 for the purpose of placing the label 53 in position.

Figure 9A:
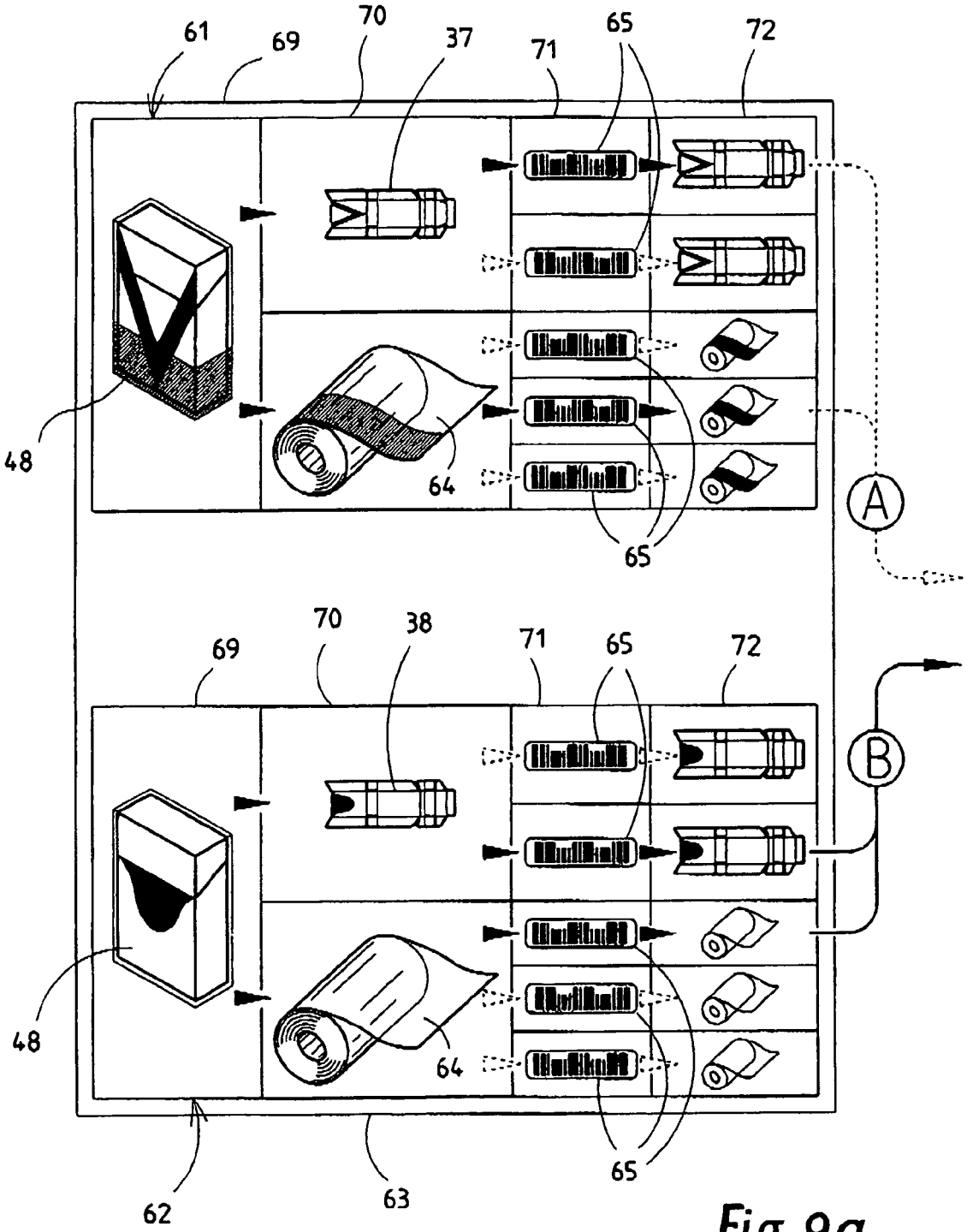
FIGS. 9*a* and 9*b* show a schematic illustration of the data used during changeover from a product of a first type to a product of a second type, of the relationships between the same and of the use thereof for adjusting adjustable mechanisms.
Figure 9B:
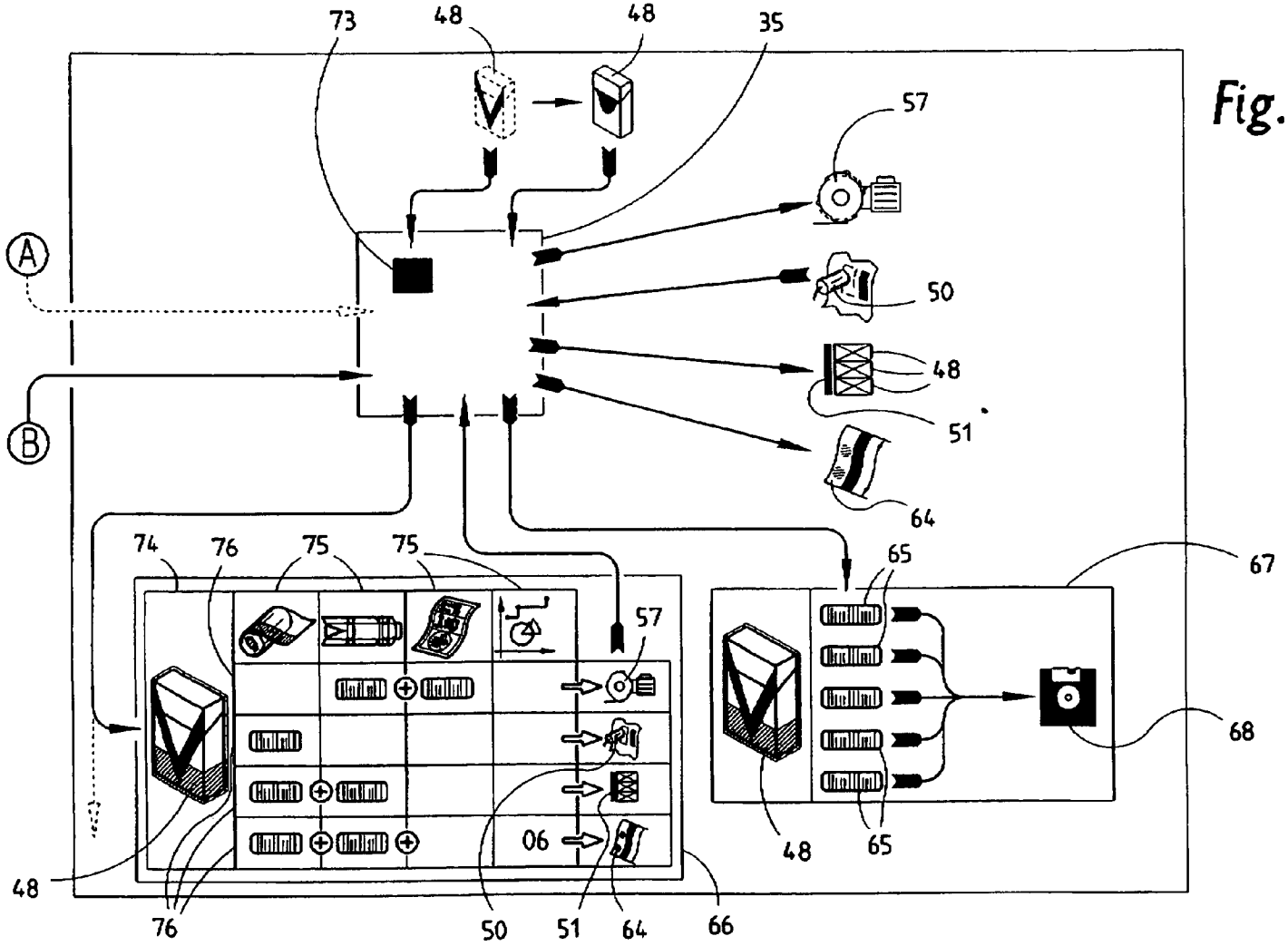

FIGS. 9*a* and 9*b* show a first and second set of parameters 61 and 62 and illustrate the effects on adjustable mechanisms of individual production units upon selection of a set of parameters 61, 62. The data contained in a set of parameters 61, 62, the parameters, are illustrated by corresponding picture symbols. First and second sets of parameters 61, 62 are stored, if appropriate, together with further sets of parameters (not illustrated) in a memory region 63, e.g. of a memory of the control arrangement 33 (FIG. 1). Each set of parameters 61, 62 describes a product, e.g. a cigarette pack 48. The first set of parameters 61 describes a cigarette pack 48 of a first type and thus a product or part of a product of a first type. The second set of parameters 62 correspondingly describes a cigarette pack 48 of a second type and thus a product or part of a product of a second type. Each set of parameters 61, 62 comprises data relating to the starting materials which are necessary for producing the respective product. The first set of parameters 61 thus comprises data relating to a first blank 37 and the second set of parameters 62 comprises data relating to a second blank 38. In addition, each set of parameters 61, 62 comprises data relating to a wrapping film 64 which is guided, as a film web 49 (FIG. 6), in the film-wrapping machine 11 (FIG. 6). In addition to the starting materials illustrated, each set of parameters 61, 62 may comprise data relating to further necessary starting materials. The cigarette packs 48 differ, as is illustrated, in shape and form on account of respectively different blanks 37, 38 for forming the cigarette box and respectively different wrapping films 64. Each set of parameters 61, 62 comprises at least one code 65 for the or each necessary starting material, the codes distinguishing, for example, a first blank 37, such as a paper or cardboard blank from a first manufacturer, from a basically similar first blank 37 from a second manufacturer. Each code 65 identifies an admissible starting material.

In FIG. 9*a*, each set of parameters 61, 62 is illustrated in the form of a tabular or matrix-like structure with four columns 69, 70, 71, 72. The first column 69 forms, as it were, a heading for the set of parameters 61, 62 in the manner of a title. When the set of parameters 61, 62 is accessed, it is possible for information which is associated with this first column 69, or the entire set of parameters 61, 62 which follows, to be presented in graphic or text form on a display, such as a screen, to an operator, for example for the purpose of selecting the set of data 61, 62. The second column 70 comprises the necessary starting materials. The equivalent of the second column 70 in the memory is, for example, a field with a certain number of field elements, a dedicated field element being provided for each necessary starting material. Each element of the column 70, with a first element having the blank 37, 38, a second element having the wrapping film 64 and, if appropriate, further elements (not illustrated), corresponds to such a field element. In order for it to be possible for basically any desired number of necessary starting materials to be assigned to each set of parameters 61, 62, the equivalent of the second column 70 in the memory may also be a dynamic data structure, e.g. a list which is interlinked on one or both sides. Such a list comprises a number of lift elements which is coordinated with the number of necessary starting materials, each element of the column 70 corresponding to such a list element. On account of the basic equivalence of field and list and field element and list element, the field and list and field element and list element are referred to hereinbelow for short as field and field element. The third column 71 comprises a number of codes 65 for each necessary starting material, each code 65 identifying an admissible starting material. According to FIG. 9, in the first and second sets of parameters 61, 62, each blank 37, 38 is assigned two codes 65 and each wrapping film 64 is assigned three codes 65. The two codes 65 for the or each blank 37, 38 and the three codes 65 for each wrapping film 64 are filed in dedicated fields in each case in the memory, each code 65 corresponding to a field element. The fourth column 72 comprises, for each code 65, data relating to the respective admissible starting material identified by the code 65. These data may also comprise manipulated variables for adjusting adjustable mechanisms. If the manipulated variables are not stored in the set of parameters 61, 62, they are located in a separate database 66. Otherwise, these data comprise, for example, information relating to the nature of the respective admissible starting material, such as thickness or weight. A hierarchical structure is thus achieved overall in the memory. A first field comprises a number of field elements, each field element corresponding to a set of parameters 61, 62. Each set of parameters 61, 62 comprises a second field with a number of field elements, each field element corresponding to a necessary starting material. Each of these field elements comprises a third field with a number of field elements, each field element comprising a code 65 for identifying an admissible starting material. Each of these field elements are assigned data relating to the respective starting material.

The changeover from products of the first type to products of the second type takes place, for example, by the second set of parameters 62 being selected instead of the previously selected first set of parameters 61. (Data which are selected or determined as being appropriate are identified by solid arrows or filled-in arrow tips, in contrast to the non-selected or inappropriate data, which is identified by dashed arrows). This selection is made by an operator, for example, by means of an input and output unit, for example a keyboard and screen of the control arrangement 33 (FIG. 1). Following such a product changeover, the material code of the starting materials which are present at the respective production units is checked. This can be done by reading out the material code which is respectively assigned to the or each starting material. For this purpose, means such as, in particular, a transponder 46 (FIG. 4) and an associated reader 47 (FIG. 4) for picking up in each case one material code of the or each respectively fed starting material is provided for each production unit. The material code for a starting material supplied on a reel 25 (FIG. 4) is stored, for example, in a transponder 46 assigned to the reel 25. The or each production unit is assigned a machine controller 35 (see also FIG. 1), under the control of which, brought about by the control device 33, the material code is read out. If a production unit has picked up the material code of the respectively fed starting material, it is checked as to whether a matching code 65 is contained in the set of parameters 62 selected during the product changeover. If, for at least one material code, no matching code 65 is found in the selected set of parameters 62, an error signal is generated, this being output, for example, on a screen assigned to the control arrangement 33. A picked-up material code and a code 65 in the set of parameters 62 match, for example, if they correspond completely or in respect of a predetermined or predeterminable number of significant bits. As an alternative, or in addition, it may also be provided that each production unit is automatically fed appropriate starting material corresponding to the selected set of parameters 62, for example by the material conveyor 26 (FIG. 1). For this purpose, the material code of starting material supplied in the storage area 24 (FIG. 1) is read out and, upon location of a starting material with a material code matching the code 65, the starting material is removed from the storage area 24 and fed to the respective production unit. If the or each necessary starting material cannot be fed to at least one production unit, an error signal is generated.

Upon determination of a code 65 from the selected set of parameters 62 which matches a material code, a manipulated variable, for adjusting the or each adjustable mechanism of the production unit, which is associated with the code 65 determined or the material code picked up, is transmitted to the respective production unit. The or each manipulated variable here is taken either from the selected set of parameters 62 or from the database 66, access to the respective manipulated variable being possible by way of the code 65 determined or the material code picked up, in the manner of an index or the like.

Either on a continuous basis during the production process, but at least prior to the adjustment of the adjustable mechanisms in accordance with the data of the selected set of parameters 62, that is to say during product changeover, material-specific data 68, e.g. consumption or reject or disruption quotas, are filed, by way of the code 65 or material code, in a production data acquisition means 67, in order to detect which material is best suited for the production process. This material-specific data 68 is accessed by way of a code 65, if appropriate the same code 65 which is also used in the set of parameters 61, 62, in the manner of an index. The respective material-specific data 68 are presented as a picture symbol in the form of a floppy disk. The production data acquisition 67 takes place separately, in particular, for different products, that is to say, for example, for different types of cigarette packs 48.

Prior to the adjustment of the adjustable mechanisms in accordance with the data of the database 66 (or of the selected set of parameters 62), the hitherto valid settings of the or each production unit and/or of the or each adjustable mechanism are stored for possible subsequent reuse. The settings which are stored in this way can also deviate from the manipulated variables stored and can even replace these, if appropriate, if the settings are based on adaptations carried out by the operating staff. It is then possible to select whether the last-valid settings have improved the production sequence. If this is the case, the associated manipulated variables in the database 66 are modified correspondingly. This allows continuous improvement of the production sequence in the manner of an evolutionary strategy. The data which are stored in this way include, for example, the data relating to the adjustment of the CCD camera 54, as has been explained above. The storage of the last-valid settings prior to the product changeover is illustrated by a set of data 73 assigned to the respective machine controller 35. The set of data 73 comprises data relating to the adjustment of the adjustable mechanism for producing the product of the first type, such as the cigarette pack 48, which have been used in the production process up until the product changeover (arrow from the dashed-line cigarette pack 48 to the set of data 73). For subsequent reuse, individual data or all the data are accepted into the database 66, for example, in accordance with selection by an operator.

A cam plate 57 (see also FIG. 7), a light barrier 50 (see also FIG. 6) in the form of an optical sensor, a heater 51 (see also FIG. 6) in the form of a sealing mechanism, and a variable length of wrapping film 64 are illustrated in order to portray manipulated variables which are each associated with a code 65 or material code in the database 66. One or more codes 65 may be associated with a single manipulated variable. It is thus possible to take account of the fact that a single starting material may require the adjustment of a plurality of adjustable mechanisms or a multiplicity of admissible starting materials may require an individual adjustment of the same adjustable mechanism in each case.

The or each manipulated variable determined in each case is transmitted from the database 66 (or the selected set of parameters 62) to the respective functional unit or the machine controller 35 thereof and, in the case of a movable adjustable mechanism, brings about, for example, a change in a relative position in relation to a reference position. In the case of the label apparatus, the transmission of the manipulated variable causes, for example, the rotary offset of the cam plate 57 of the film-wrapping machine 12 to be influenced. The transmission of the manipulated variable also gives rise, for example, to the suitable evaluation of the data supplied by the light barrier 50, in the form of an optical sensor, of the film-wrapping machine 12 and to an adaptation of the temperature of the heater 51 of the sealing mechanism of the film-wrapping machine 12. Finally, the transmission of the manipulated variable gives rise, for example, to the adjustment of a cutting length for cutting film blanks from the wrapping film 64.

The database 66 is accessed by way of the respective code 65 of the selected or supplied starting material. The database 66 is realized in the memory essentially as a field, referred to hereinbelow as a product-type-related set of parameters 74, with a number of field elements. Each product-type-related set of parameters 74 corresponds with a product, e.g. a cigarette pack 48, and comprises in turn, as a field with a number of field elements, a matrix, of which the columns 75 are assigned to individual starting materials or machine configurations and the rows 76 are assigned to the respective manipulated variables. If a starting material requires influencing of a manipulated variable, that is to say adjustment of an adjustable mechanism, the code 65 of the starting material is entered in the field assigned to the respective column 75 and row 76. When a code 65 of a starting material which is admissible and recognized as being appropriate, is transmitted to the database 66, a corresponding code 65 is searched for in the database 66. If the code 65 is found in the database 66, the or each manipulated variable of the field element to which the code 65 which has been found is assigned is transmitted to a functional unit, which can likewise be identified by way of the code 65, or the machine controller 35 of this functional unit, for adjustment of the or each adjustable mechanism. In the case of blanks 37, 38, the product-type-related set of parameters 74 comprises, for example, manipulated variables for adjusting a folding mechanism for folding the cigarette box and/or manipulated variables for adjusting glue nozzles for applying the necessary pattern of glue. In the case of the wrapping film 64, the product-type-related set of parameters 74 comprises, for example, manipulated variables for adjusting an optical sensor, such as a light barrier 50 (see also FIG. 6), for detecting, for example, printed marks on the wrapping film 64.

Figure 10:
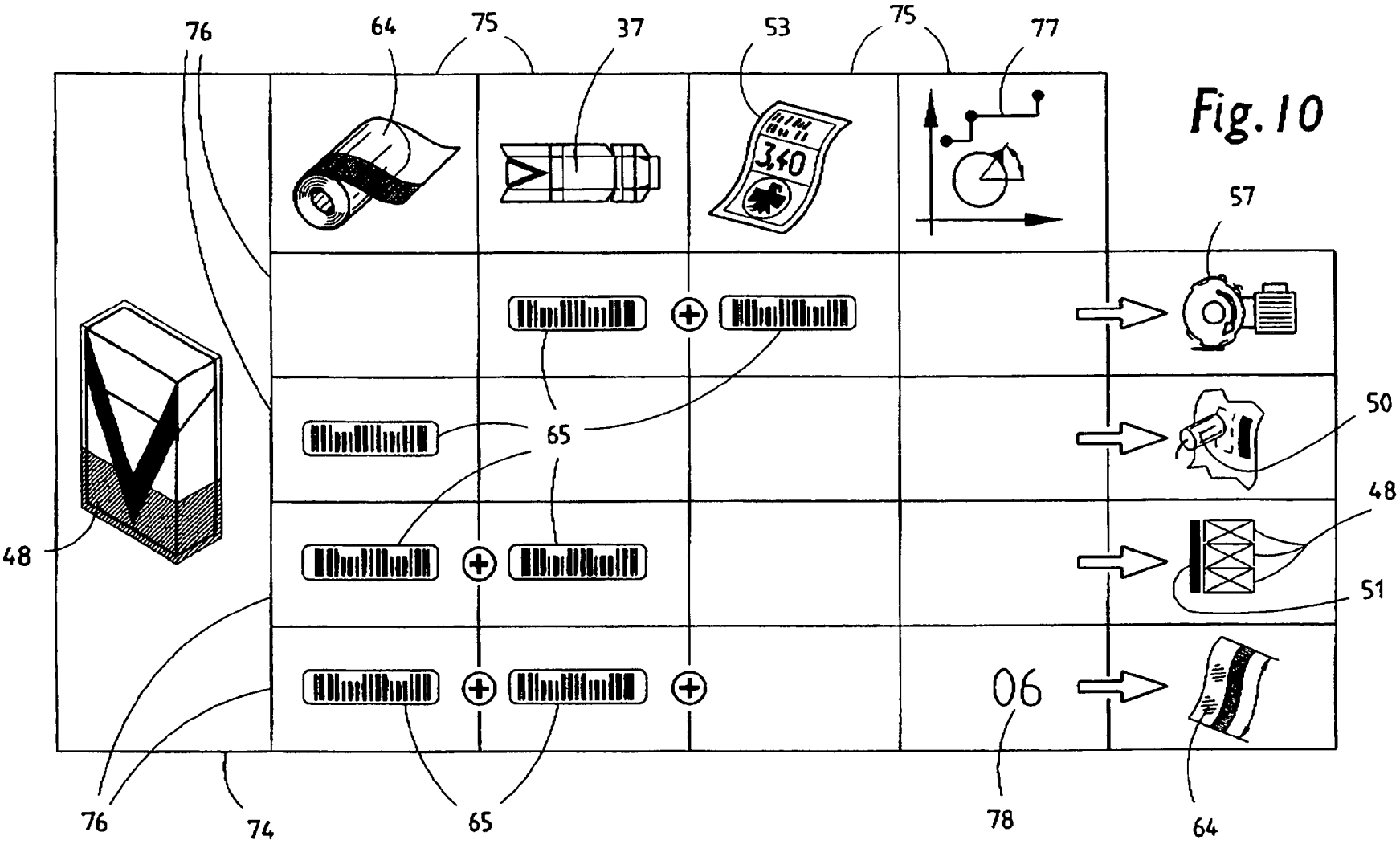
FIG. 10 shows a product-type-related set of parameters.

FIG. 10 shows the product-type-related set of parameters 74 from FIG. 9*b*. An illustration is given of a set of parameters which relates to a certain product, a cigarette pack 48, and comprises parameters, that is to say manipulated variables, for adjusting adjustable mechanisms. The manipulated variables are merely illustrated by the adjustable mechanisms themselves. The product-type-related set of parameters 74 also makes it possible to take account of dependencies between individual starting materials. If, for example for a wrapping film 64, a temperature of, for example 160° C. is predetermined as the manipulated variable for the heater 51 of the sealing mechanism, this temperature may be insufficient, in the case of a blank 37 with a coating with a high level of thermal conductivity, for reliably sealing the material ends.

There is a dependency between the blank 37 and the wrapping film 64, account being taken of this dependency by corresponding data of the product-type-related set of parameters 74. The product-type-related set of parameters 74 then contains as manipulated variable for the heater 51, for example, a temperature of, for example, 165° C., by means of which the wrapping film 64 can be reliably sealed even in conjunction with the special blank 37. The situation is similar in respect of a blank 37 and a label 53 which is to be applied thereto. In the case of a certain blank 37 and of a certain label 53, it may be provided that this label 53 is always positioned over corners. The product-type-related set of parameters 74 then contains, for this combination of starting materials, a manipulated variable for adjusting the cam plate 57 for positioning labels over corners. For manipulated variables which are dependent just on one starting material, e.g. for adjusting the light barrier 50, the set of parameters contains just the code of the respective starting material in the corresponding row 76.

The or each product-type-related set of parameters 74 can be extended or updated during operation of the line. For extending the set of parameters, additional codes 65 of individual starting materials or of a plurality of starting materials are picked up and a further row 76 with a manipulated variable assigned to the starting material or materials is generated in the process. For updating, in the case of an existing row 76, the manipulated variable is adapted to more favorable values determined during operation of the line. The operation of extending or updating the product-type-related set of parameters 74 is transparent to the user. That is to say, the user, the line operator, actuates, for example, a button or key for accepting the data from current production. The associated product-type-related set of parameters 74 is then determined in relation to the respectively finished product, that is to say, for example, in relation to the finished cigarette pack 48. This set of parameters is searched for appropriate codes 64 for each starting material used and, in the case of a code 64 being found, the respectively associated manipulated variable is updated. If the code of a starting material is not found, a new row 76 is generated and, in this row 76, the code 64 of the starting material is entered in the column 75 of the respective starting material. The associated manipulated variable is entered in the same row 76. In order to establish which of the various manipulated variables is entered for a code 64 in the product-type-related set of parameters 74, the starting material(s) on which a manipulated variable may be dependent is stored for each manipulated variable. A dependency on a plurality of starting materials is indicated by the symbol "⊕" in the illustration. The manipulated variable for adjusting the light barrier 50 is only dependent on the wrapping film 64 used. The manipulated variable for adjusting the heater 51 is dependent on the combination of wrapping film 64 and blank 37, and the manipulated variable for adjusting the cam plate 57 is dependent on the combination of blank 37 and label 53.

In addition to starting materials, at least one column 75 for machine configurations, which can likewise influence the adjustment of adjustable mechanisms, is provided in the product-type-related set of parameters 74. An example of such a machine configuration is an adjustment curve 77 for a cutting arrangement for severing the wrapping film 64. A machine-configuration value 78 which describes the machine configuration is entered in the appropriate column. The numerical value "06" indicates the sixth stage of readjustment of the cutting arrangement on account of wear. The row 76 with the machine-configuration value 78 is used when use is made of a wrapping film 64 together with a blank 37 with the codes 65 specified in the row 76 and when the cutting arrangement is in the readjustment stage specified as the machine-configuration value 78. A manipulated variable which influences the length of individual film blanks is then output to the machine controller 35. It is also possible for the product-type-related set of parameters 74 to be extended or supplemented in relation to such machine configurations. That is to say, if the cutting device is only in the third readjustment stage and the operator accepts current data and retrieves the product-type-related set of parameters 74, a further row 76 is generated, this further row comprising the codes 65 of wrapping film 64 and blank 37, the numerical value "03" as machine-configuration value 78, and the current manipulated variable for the stipulation of the length of the film blank.

The sets of parameters 61, 62 and the database 66 and the production data acquisition 67 may be stored, for example, in the memory of the control arrangement 33. As an alternative, it is also possible for the sets of parameters 61, 62 and/or the database 66 and/or the production data acquisition 67 to be stored in a distributed manner, that is to say, for example, in a memory of each machine controller. This renders superfluous, if appropriate, the control arrangement 33 in the form of a central controller, with the result that each production unit can be controlled by a dedicated, decentralized machine controller 35. It is also possible to have individual optimization of the parameters for adjusting adjustable mechanisms for each machine controller 35.

| List of designations | |
|---|---|
| 10 | Maker |
| 11 | Packer |
| 12 | Film-wrapping machine |
| 13 | Multipacker |
| 14 | Cartoner |
| 15 | Cigarette conveyor |
| 16 | Cigarette store |
| 17 | Blank store |
| 18 | Pack conveyor |
| 19 | Multipack conveyor |
| 20 | Shipping carton |
| 21 | Removal conveyor |
| 22 | Pack store |
| 23 | Filter-attachment machine |
| 24 | Storage area |
| 25 | Reel |
| 26 | Material conveyor |
| 27 | Conveying path |
| 28 | Filter-attachment paper |
| 29 | Collar material |
| 30 | Inner-liner material |
| 31 | Film material |
| 32 | Cigarette paper |
| 33 | Control arrangement |
| 34 | Field bus |
| 35 | Machine controller |
| 36 | |
| 37 | Blank |
| 38 | Blank |
| 39 | Areas of glue |
| 40 | Lid inner tab (long) |
| 41 | Lid inner tab (short) |
| 42 | Spindle |
| 43 | Plate |
| 44 | Stub |
| 45 | Reel core |
| 46 | Transponder |
| 47 | Reader |
| 48 | Cigarette packs |
| 49 | Cellophane web |
| 50 | Light barrier |
| 51 | First heater |
| 52 | Second heater |
| 53 | Label |
| 54 | CCD camera |

-continued

| List of designations | |
|---|---|
| 55 | Label store |
| 56 | Servomotor |
| 57 | Cam plate |
| 58 | Pressure-exerting disk |
| 59 | Conveying belt |
| 60 | Carry-along element |
| 61 | First set of parameters |
| 62 | Second set of parameters |
| 63 | Memory region |
| 64 | Wrapping film |
| 65 | Code |
| 66 | Database |
| 67 | Production data acquisition (means) |
| 68 | Data |
| 69 | Column |
| 70 | Column |
| 71 | Column |
| 72 | Column |
| 73 | Set of data |
| 74 | Production-type-related set of parameters |
| 75 | Column |
| 76 | Row |
| 77 | Adjustment curve |
| 78 | Machine-configuration value |

What is claimed is:

1. A production and packaging installation having a control arrangement (33) and production units having adjustable mechanisms for the production and packaging of, first, cigarette products of a first type and, thereafter, cigarette products of a second type, with the control arrangement (33) having a communications interlace, the installation further comprising:

a) at least a first set (61) of parameters associated with the products of the first type and a second set (62) of parameters associated with the products of the second type, wherein the sets (61, 62) of parameters are stored in a selectable manner in a memory of the control arrangement (33), with each of the sets of (61, 62) of parameters containing a number of necessary starting materials;

b) at least one product-type-related set of parameters (74) also stored in the memory of the control arrangement (33) for each of the product types, the at least one product-type-related set of parameters (74) comprising at least one manipulated variable for adjusting an adjustable mechanism, said variable being dependent on at least two types of starting materials, with a first value of the at least one manipulated variable relating to a first combination of certain starting materials of said at least two types of starting materials being stored in the product-type-related set of parameters (74), with a second value of the at least one manipulated variable, differing from the first value of the at least one manipulated variable, relating to a second combination of certain starting materials of said at least two types of starting materials being stored in the product-type-related set of parameters (74), and with all starting materials of the first combination differing in each case from the starting materials of the second combination;

c) upon selection of one of the sets (61, 62) of parameters, a manipulated variable for adjusting the or each adjustable mechanism is transmitted to at least one of the production units by the control arrangement (33) by way of the communications interface of the control arrangement; and d) the manipulated variable is transmitted as determined by the selected parameters of the set (61, 62) of parameters and/or as determined by the product-type-related set of parameters.

2. The production and packaging installation according to claim 1, wherein:

a) the production units have at least one cigarette production machine (10), a packaging machine (11), and at least one additional machine selected from the group consisting of a film-wrapping machine (12), a multi-packer (13), and a carton packer (14), for the production and packaging of, first, cigarettes and cigarette packs of a first type and, thereafter, cigarettes and cigarette packs of a second type, and b) the mechanisms adjustable in accordance with the selected set (61, 62) of parameters are selected from the group consisting of a label apparatus for the application of revenue strips to cigarette packs, folding members of the packer (11), heating and/or pressure-exerting elements of the film-wrapping machine (12), a CCD, and an optic transmitter.

3. The production and packaging installation according to claim 1, wherein:

a) the first and second sets (61, 62) of parameters stored in the memory of the control arrangement (33) encompass at least one code (65) for each necessary starting material, b) the starting material supplied at the production units is assigned an individual, ascertainable material code, and c) in the selection of the set (61, 62) of parameters the material code of the starting material provided at the production units concerned is compared with the corresponding code taken from the selected set (61, 62) of parameters.

4. The production and packaging installation according to claim 3, wherein an error signal is generated if at least one of the material code does not correspond to the corresponding one of the at least one code (65) from the selected set (61, 62) of parameters.

5. The production and packaging installation according to claim 3, wherein each of the sets (61, 62) of parameters contains a number of necessary starting materials and the at least one code (65) for the or each necessary starting material.

6. The production and packaging installation according to claim 3, wherein:

a) each production unit has electronic transponders (46) and readers (47) associated therewith for the purpose of recording in each case a material code of the or each respectively fed starting material, and b) upon determination of the at least one code (65) from the set (61, 62) of parameters that matches the material code, the manipulated variable, for adjusting the or each adjustable mechanism, which is associated with this code (65) or this material code is transmitted to the respective production unit by the control arrangement (33).

7. The production and packaging installation according to claim 3, wherein:

a) the or each necessary starting material provided with the material code is fed to each of the production units, with account being taken of a comparison between the code (65) and the material code, and b) the manipulated variable for adjusting the or each adjustable mechanism and which is associated with this code (65) or this material code is transmitted by the control arrangement (33).

8. The production and packaging installation according to claim 3, wherein:

a) at least one of the product-type-related set of parameters for taking account of dependencies between individual starting materials is provided for each of the product types, and b) instead of the manipulated variable which is associated with a starting material which is dependent on another starting material, a manipulated variable which is associated with a corresponding parameter of the product-type-related set of parameters is transmitted to the respective production unit.

9. The production and packaging installation according to claim 3, wherein a relative position of the adjustable mechanism is changeable in relation to a reference position.

10. The production and packaging installation according to claim 3, wherein, as determined by the selected set (61) of parameters, rotatable elements with projections (57) are adjusted with respect to at least one of the members of the group consisting of the relative position, the folding elements, the heating members relating to temperature, the pressure-exerting members relating to pressure, and optical and opto-electronic sensors relating to response behavior.

11. The production and packaging installation according to claim 3, wherein prior to the adjustment of the or each adjustable mechanism, the hitherto valid settings of the or each production unit and/or of the or each adjustable mechanism are stored for possible subsequent re-use.

12. The production and packaging installation according to claim 2, wherein:

a) the first and second sets (61, 62) of parameters stored in the memory of the control arrangement (33) encompasses at least one code (65) for each necessary starting material, b) the starting material supplied at the production units is assigned an individual, ascertainable material code, and c) in the selection of the set (61, 62) of parameters the material code of the starting material provided at the production units concerned is compared with the corresponding code taken from the selected parameter set (61, 62).

13. The production and packaging installation according to claim 12, wherein an error signal is generated if at least one identified of the material code does not correspond to the corresponding code (65) from the selected set of parameters (61, 62).

14. The production and packaging installation according to claim 12, wherein each of the sets (61, 62) of parameters contains a number of necessary starting materials and the at least one code (65) for the or each necessary starting material.

15. The production and packaging installation according to claim 12, wherein:

a) each of the production units has electronic transponders (46) and readers (47) associated therewith for the purpose of recording in each case the material code of the or each respectively fed starting material, and b) upon determination of the code (65) from the set (61, 62) of parameters that matches the material code, a manipulated variable, for adjusting the or each adjustable mechanism, which is associated with this code (65) or thus material code is transmitted to the respective production unit by the control arrangement (33).

16. The production and packaging installation according to claim 12, wherein:

a) the or each necessary starting material provided with the material code is fed to each of the production units, with account being taken of a comparison between the code (65) and the material code, and b) a manipulated variable for adjusting the or each adjustable mechanism and which is associated with this code (65) or this material code is transmitted by the control arrangement (33).

17. The production and packaging installation according to claim 12, wherein:

a) at least one of the product-type-related set of parameters for taking account of dependencies between the individual starting materials is provided for each of the product types, and b) instead of the manipulated variable which is associated with the starting material which is dependent on another starting material, a manipulated variable which is associated with a corresponding parameter of the product-type-related set of parameters is transmitted to the respective production unit.

18. The production and packaging installation according to claim 12, wherein a relative position of the adjustable mechanism is changeable in relation to a reference position.

19. The production and packaging installation according to claim 12, wherein, as determined by the selected set (61) of parameters, rotatable elements with projections (57) are adjusted with respect to at least one of the members of the group consisting of the relative position, the folding elements, the heating members relating to temperature, the pressure-exerting members relating to pressure, and optical and opto-electronic sensors relating to response behavior.

20. The production and packaging installation according to claim 12, wherein prior to the adjustment of the or each adjustable mechanism, the hitherto valid settings of the or each production unit and/or of the or each adjustable mechanism are stored for possible subsequent re-use.

21. The production and packaging installation according to claim 1, wherein:

a) the first and second sets (61, 62) of parameters stored in the memory of the control arrangement (33) encompasses a code (65) for each necessary starting material, b) the starting material supplied at the production units concerned has an ascertainable material code, and c) upon selection of the set (61, 62) of parameters the appropriate starting material is fed to the production units associated with the code (65) of the selected set (61, 62) of parameters.

22. The production and packaging installation according to claim 21, wherein an error signal is generated if at least one identified of the material code does not correspond to the corresponding code (65) from the selected set (61, 62) of parameters.

23. The production and packaging installation according to claim 21, wherein each of the sets (61, 62) of parameters contains a number of necessary starting materials and at least one of the code (65) for the or each necessary starting material.

24. The production and packaging installation according to claim 21, wherein:

a) each of the production units has electronic transponders (46) and readers (47) associated therewith for the purpose of recording in each case the material code of the or each respectively fed starting material, and b) upon determination of the code (65) from the set (61, 62) of parameters which matches the material code, a manipulated variable, for adjusting the or each adjustable mechanism, which is associated with this code (65) or this material code is transmitted to the respective production unit by the control arrangement (33).

25. The production and packaging installation according to claim 21, wherein:

a) the or each necessary starting material provided with the material code is fed to each of the production units, with account being taken of a comparison between the code (65) and the material code, and b) a manipulated variable for adjusting the or each adjustable mechanism and which is associated with this code (65) or this material code is transmitted by the control arrangement (33).

26. The production and packaging installation according to claim 21, wherein:

a) at least one of the product-type-related set of parameters for taking account of dependencies between the individual starting materials is provided for each of the product types, and b) instead of the manipulated variable which is associated with the starting material which is dependent on another starting material, a manipulated variable which is associated with a corresponding parameter of the product-type-related set of parameters is transmitted to the respective production unit.

27. The production and packaging installation according to claim 21, wherein a relative position of the adjustable mechanism is changeable in relation to a reference position.

28. The production and packaging installation according to claim 21, wherein, as determined by the selected set (61) of parameters, rotatable elements with projections (57) are adjusted with respect to at least one of the members of the group consisting of the relative position, the folding elements, the heating members relating to temperature, the pressure-exerting members relating to pressure, and optical and opto-electronic sensors relating to response behavior.

29. The production and packaging installation according to claim 21, wherein prior to the adjustment of the or each adjustable mechanism, the hitherto valid settings of the or each production unit and/or of the or each adjustable mechanism are stored for possible subsequent re-use.

30. The production and packaging installation according to claim 2, wherein:

a) the first and second sets (61, 62) of parameters stored in the memory of the control arrangement (33) encompasses a code (65) for each necessary starting material, b) the starting material supplied at the production units concerned has an ascertainable material code, and c) upon selection of the set (61, 62) set of parameters the appropriate starting material is fed to the production units associated with the code (65) of the selected set (61, 62) of parameters.

31. The production and packaging installation according to claim 30, wherein an error signal is generated if at least one identified of the material code does not correspond to the corresponding code (65) from the selected set (61, 62) of parameters.

32. The production and packaging installation according to claim 30, wherein each set (61, 62) of parameters contains a number of necessary starting materials and at least one of the code (65) for the or each necessary starting material.

33. The production and packaging installation according to claim 30, wherein:

a) each of the production units has electronic transponders (46) and readers (47) associated therewith for the purpose of recording in each case the material code of the or each respectively fed starting material, and b) upon determination of the code (65) from the set (61, 62) of parameters that matches the material code, a manipulated variable, for adjusting the or each adjustable mechanism, which is associated with this code (65) or this material code is transmitted to the respective production unit by the control arrangement (33).

34. The production and packaging installation according to claim 30, wherein:

a) the or each necessary starting material provided with the material code is fed to each of the production units, with account being taken of a comparison between the code (65) and the material code, and b) a manipulated variable for adjusting the or each adjustable mechanism and which is associated with this code (65) or this material code is transmitted by the control arrangement (33).

35. The production and packaging installation according to claim 30, wherein:

a) at least one of the product-type-related set of parameters for taking account of dependencies between individual starting materials is provided for each of the product types, and b) instead of the manipulated variable which is associated with the starting material which is dependent on another starting material, a manipulated variable which is associated with a corresponding parameter of the product-type-related set of parameters is transmitted to the respective production unit.

36. The production and packaging installation according to claim 30, wherein a relative position of the adjustable mechanism is changeable in relation to a reference position.

37. The production and packaging installation according to claim 30, wherein, as determined by the selected set (61) of parameters, rotatable elements with projections (57) are adjusted with respect to at least one of the members of the group consisting of the relative position, the folding elements, the heating members relating to temperature, the pressure-exerting members relating to pressure, and optical and opto-electronic sensors relating to response behavior.

38. The production and packaging installation according to claim 30, wherein prior to the adjustment of the or each adjustable mechanism, the hitherto valid settings of the or each production unit and/or of the or each adjustable mechanism are stored for possible subsequent re-use.

39. A production and packaging installation having a control arrangement (33) and production units having adjustable mechanisms for the production and packaging of cigarette products of at least two types, with the control arrangement (33) having a communications interface, the installation further comprising:

a) at least a first set (61) of parameters associated with the products of a first type and a second set (62) of parameters associated with the products of a second type, wherein the sets (61, 62) of parameters are stored in a selectable manner in a memory of the control arrangement (33), with each of the sets (61, 62) of parameters containing a number of necessary starting materials;

b) at least one product-type-related set of parameters (74) also stored in the memory of the control arrangement (33) for each of the product types, the at least one product-type-related set of parameters (74) comprising at least one manipulated variable for adjusting an adjustable mechanism, said variable being dependent on at least two types of starting materials, with a first value of the at least one manipulated variable relating to a first combination of certain starting materials of said at least two types of starting materials being stored in the product-type-related set of parameters (74), with a second value of the at least one manipulated variable, differing from the first value of the at least one manipulated variable, relating to a second combination of certain starting materials of said at least two types of starting materials being stored in the product-type-related set of parameters (74), and with the starting materials of the first combination differing in each case from the starting materials of the second combination;

c) upon selection of one of the sets (61, 62) of parameters, a manipulated variable for adjusting the or each adjustable mechanism is transmitted to at least one of the production units by the control arrangement (33) by way of the communications interface of the control arrangement; and d) the manipulated variable is transmitted as determined by the selected parameters of the set (61, 62) of parameters and/or as determined by the product-type-related set of parameters, wherein the installation can switch or be switched between the production and packaging of the at least two types of cigarette products.

* * * * *